US006216484B1

(12) United States Patent
Yun

(10) Patent No.: US 6,216,484 B1
(45) Date of Patent: Apr. 17, 2001

(54) AIR FLOW SWITCHING TYPE AIR CONDITIONER FOR BOTH COOLING AND HEATING

(76) Inventor: Meyong Hyek Yun, 6-302, Obokvilla, 371-19, Dorin-dong, Namdong-gu, Inchon 405-280 (KR)

( * ) Notice: Subject to any disclaimer, the term of this patent is extended or adjusted under 35 U.S.C. 154(b) by 0 days.

(21) Appl. No.: 09/424,234

(22) PCT Filed: May 22, 1998

(86) PCT No.: PCT/KR98/00128

§ 371 Date: Nov. 29, 1999

§ 102(e) Date: Nov. 29, 1999

(87) PCT Pub. No.: WO98/55806

PCT Pub. Date: Dec. 10, 1998

(30) Foreign Application Priority Data

Jun. 5, 1997 (KR) ..... 97-23339

(51) Int. Cl.[7] ..... F25B 29/00; F25D 17/06

(52) U.S. Cl. ..... 62/325; 62/428

(58) Field of Search ..... 62/325, 426, 427, 62/428

(56) References Cited

U.S. PATENT DOCUMENTS 4,199,959 * 4/1980 Wurm ..... 62/325 X
4,478,053 * 10/1984 Yano et al. ..... 62/325 X
5,372,189 12/1994 Tsunekawa et al. .
5,816,066 * 10/1998 Aoki et al. ..... 62/325

FOREIGN PATENT DOCUMENTS 0 738 857 10/1996 (EP) .
363-197829 * 8/1988 (JP) .
407-243660 * 9/1995 (JP) .
WO 93/18351 9/1993 (WO) .

* cited by examiner

*Primary Examiner*—Corrine McDermott
*Assistant Examiner*—Chen-Wen Jiang
(74) *Attorney, Agent, or Firm*—Bacon & Thomas PLLC

(57) ABSTRACT

An air flow switching type air conditioner device for both cooling and heating. The air conditioner device including a compressor (4), a condenser (3), an evaporator (2), and a refrigerant pipe (9) connecting the compressor, the condenser, and the evaporator. The device includes an air blower (10), a case (1) with an indoor side discharge port (11) and an indoor side intake port (12). Both the indoor ports (11, 12) being openable towards the inside of a room. The device further includes an outdoor side discharge port (13) and an outdoor side intake port (14), with both outdoor ports openable to the outside of a room and separately partitioned by partition walls (25,26) The device includes a heat exchange chamber (20) positioned between the indoor side discharge port and the indoor side intake port and between the outdoor side discharge port and the outdoor side intake port. The device further includes a series of dampers that are moveable to control flow of air through the ports. The device also includes a controller connected to and arranged to individually control the opening and closing of the dampers.

4 Claims, 5 Drawing Sheets

AIR FLOW SWITCHING TYPE AIR CONDITIONER FOR BOTH COOLING AND HEATING

BACKGROUND OF THE INVENTION

1. Field of the Invention

The present invention relates to an air flow switching type air conditioner for both cooling and heating, and more particularly to an air conditioner for both cooling and heating which allows an efficient function of cooling and heating by optionally switching the indoor and outdoor air to flow either through an evaporator or through a condenser, and which can also serve as thermo-hygrostat.

2. Description of the Related Art

The conventional air conditioner for purpose of both cooling and heating had a construction equipped with both a cooling refrigeration cycle and a heater. Alternative type of air conditioner for both cooling and heating was constructed as a heat pump which has a heat exchanger at indoor side and another heat exchanger at outdoor side and directional valve for switching the flow of refrigerant. At cooling mode, the indoor heat exchanger functions as an evaporator to absorb heat from the room, and at heating mode, the indoor heat exchanger functions as a condenser to deliver heat into room. However, those conventional air conditioners for both cooling and heating were relatively complicated in structure and the cooling or heating efficiency was low, causing manufacturing and maintenance cost to increase.

SUMMARY OF THE INVENTION

The present invention, which is intended to resolve the drawbacks of the conventional air conditioners as described above, has the purpose of providing an air conditioner for both cooling and heating with novel structure, which can perform the function of cooling and heating by simply switching the direction of the air flow in and out of a room on a conventional cooling refrigeration cycle.

Furthermore, the present invention is intended to provide an air conditioner for not only cooling but also heating which can recover energy contained in the exhaust air during the indoor air ventilation and which can also precisely control or maintain the temperature and humidity in the room.

DETAILED DESCRIPTION OF THE INVENTION

Figure 1:
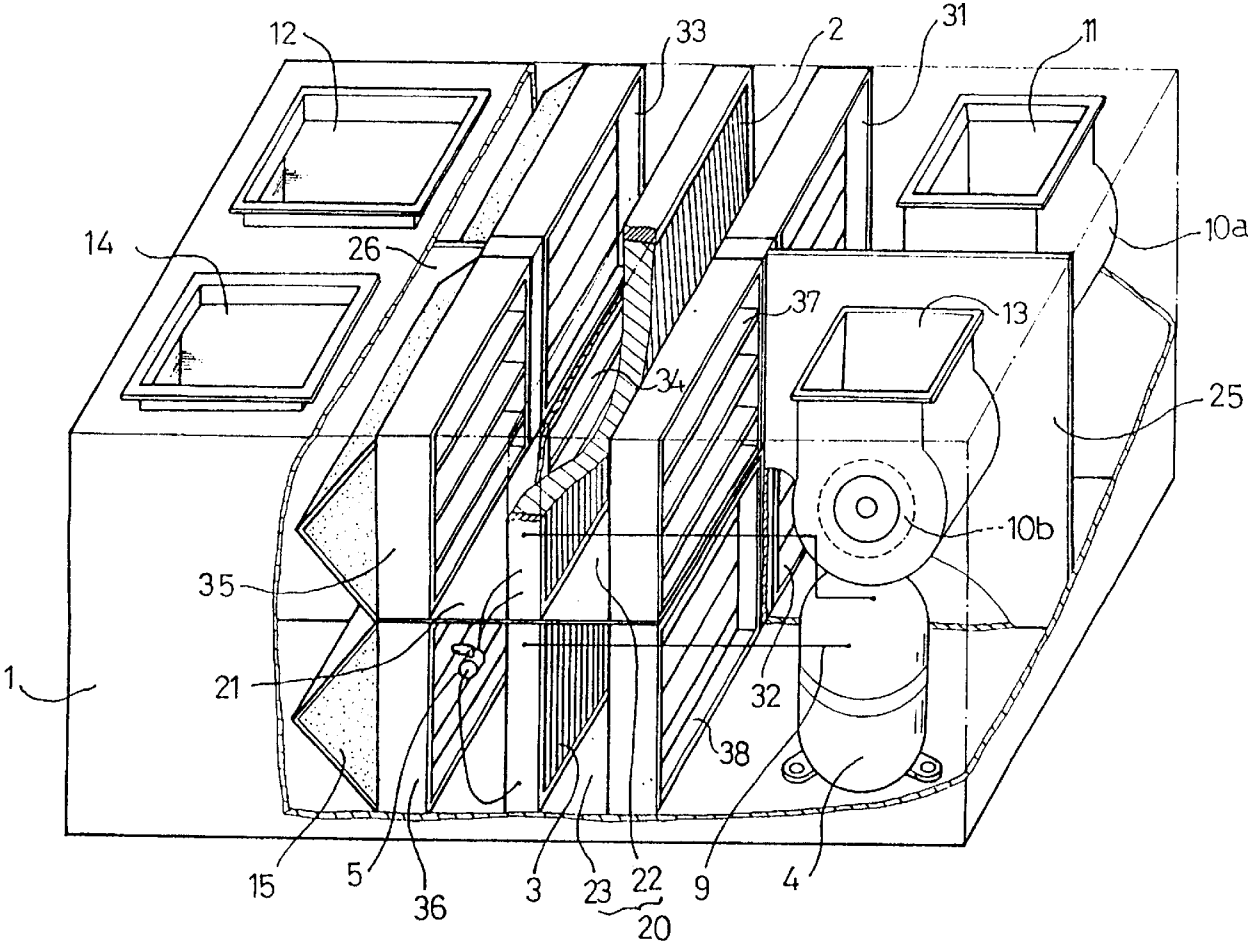
FIG. 1 shows a perspective view of a preferred embodiment according to the present invention with its part sectioned.

According to the present invention, there is provided an air flow switching type air conditioner for both cooling and heating having a compressor 4, condenser 3, an expansion valve 5 or capillary tube, an evaporator 2 and a refrigerant pipe 9 connecting those parts, as well as an air blower 10, said air conditioner specifically including a case 1 which is so constructed that an indoor side discharge port 11 and an indoor side intake port 12, both parts being open to the inside of a room, as well as an outdoor side discharge port 13 and an outdoor side intake port 14, both parts being open to the outside, are separately partitioned by partition walls 25,26, a heat exchange chamber 20 which is formed between said indoor side discharge port 11 and indoor side intake port 12 and between said outdoor side discharge port 13 and outdoor side intake port 14 and in which said evaporator and said condenser are each disposed in a partitioned space, a first damper 31 provided between said evaporator 2 and said indoor side discharge port 11, a second damper 32 provided between said condenser 3 and said indoor side discharge port 11, a third damper 33 provided between said indoor side intake port 12 and said evaporator 2, a forth damper 34 provided between said indoor side intake port 12 and said condenser 3, a fifth damper 35 provided between said outdoor side discharge port 13 and said evaporator 2, a sixth damper 36 provided between said condenser 3 and said outdoor side discharge port 13, a seventh damper 37 provided between said outdoor side intake port 14 and said evaporator 2 and a eighth damper 38 provided between said outdoor side intake port 14 and said condenser 3, and wherein there is further included a controller by which the opening of said dampers is individually controlled.

According to another feature of the present invention, said heat exchange chamber 20 is partitioned into upper and lower heat exchange chambers 22,23 by a horizontal partition plate 21, so that the evaporator 2 is arranged in said upper heat exchange chamber 22 and the condenser 3 is arranged in said lower heat exchange chamber 23, whereby condensing water produced in said evaporator 2 should flow down to said condenser 3.

According to a further feature of the invention, a humidity sensor 7 is provided at a predetermined position in the interior of a room R, and a reheater 6 for emitting condensing heat is connected between said condenser 3 and an expansion valve 5 or capillary tube, and wherein said reheater 6 is positioned between said evaporator 2 and said indoor air discharge port 11 to heat the air discharging into the inside of the room.

A preferred embodiment of the present invention is explained below in connection with the attached drawings. FIG. 1 shows the perspective view of a preferred embodiment of the invention which is partly sectioned and FIGS. 2 and 3 each show the operating state at cooling and heating mode. As can be seen, an indoor side discharge port 11 and an indoor side intake port 12 are formed opposite to the set of an outdoor side discharge port 13 and an outdoor side intake port 14 in a case 1. The indoor side discharge port 11 and the outdoor side discharge port 13 are separated by a partition wall 25, while the indoor side intake port 12 and the outdoor side intake port 14 are separated by a partition wall 26. Between the discharge ports 11,13 and the intake ports 12,14 there is formed a heat exchange chamber 20, which is bounded by the respective dampers 31–38. The heat exchanger room 20 in turn is divided by the horizontally disposed partition plate 21 into the upper heat exchange chamber 22 for receiving the evaporator 2 and the lower heat exchange chamber 23 for receiving a condenser 3. Condensing water produced on the evaporator 2 in the upper heat exchange chamber 22 falls to the condenser 3 in the lower heat exchange chamber 23 via appropriate drains formed on the partition plate 21 to thereby increase the heat efficiency of condenser 3.

Referring to the dampers mentioned above, they are in the form of blinds or blades to regulate the opening for air flow in accordance with the control of a controller(not shown). The first damper 31 is disposed between the evaporator 2 and the indoor side discharge port 11 and so constructed as to regulate the flow rate of the air between them. Similarly a second damper 32 is disposed between the condenser 3 and the indoor side discharge port 11. And, the third damper 33 is disposed between the indoor side intake port 12 and the evaporator 2, the forth damper 34 between the indoor side intake port 12 and the condenser 3, the fifth damper 35 between the outdoor side intake port 14 and the evaporator 2, the sixth damper 36 between the outdoor side intake port 14 and the condenser 3, the seventh damper 37 between the outdoor side discharge port 13 and the evaporator 2, and the eight damper 38 between the outdoor side discharge port 13 and the condenser 3.

In the indoor side discharge port 11 there is disposed a blower 10*a* and in the outdoor side discharge port 13 there is disposed another blower 10*b*. The numeral 4 stands for a compressor and the numeral 5 denotes an expansion valve, which may however be replaced by a capillary tube for a small capacity. They are connected to a refrigerant pipe 9 to form a conventional refrigeration cycle. Between the indoor or outdoor side intake port 12 or 14 and the dampers facing them 33 and 34 or 35 and 36 there are provided filters 15. The compressor 4 mentioned above may be installed outside of the case 1 depending on its capacity.

Figure 2:
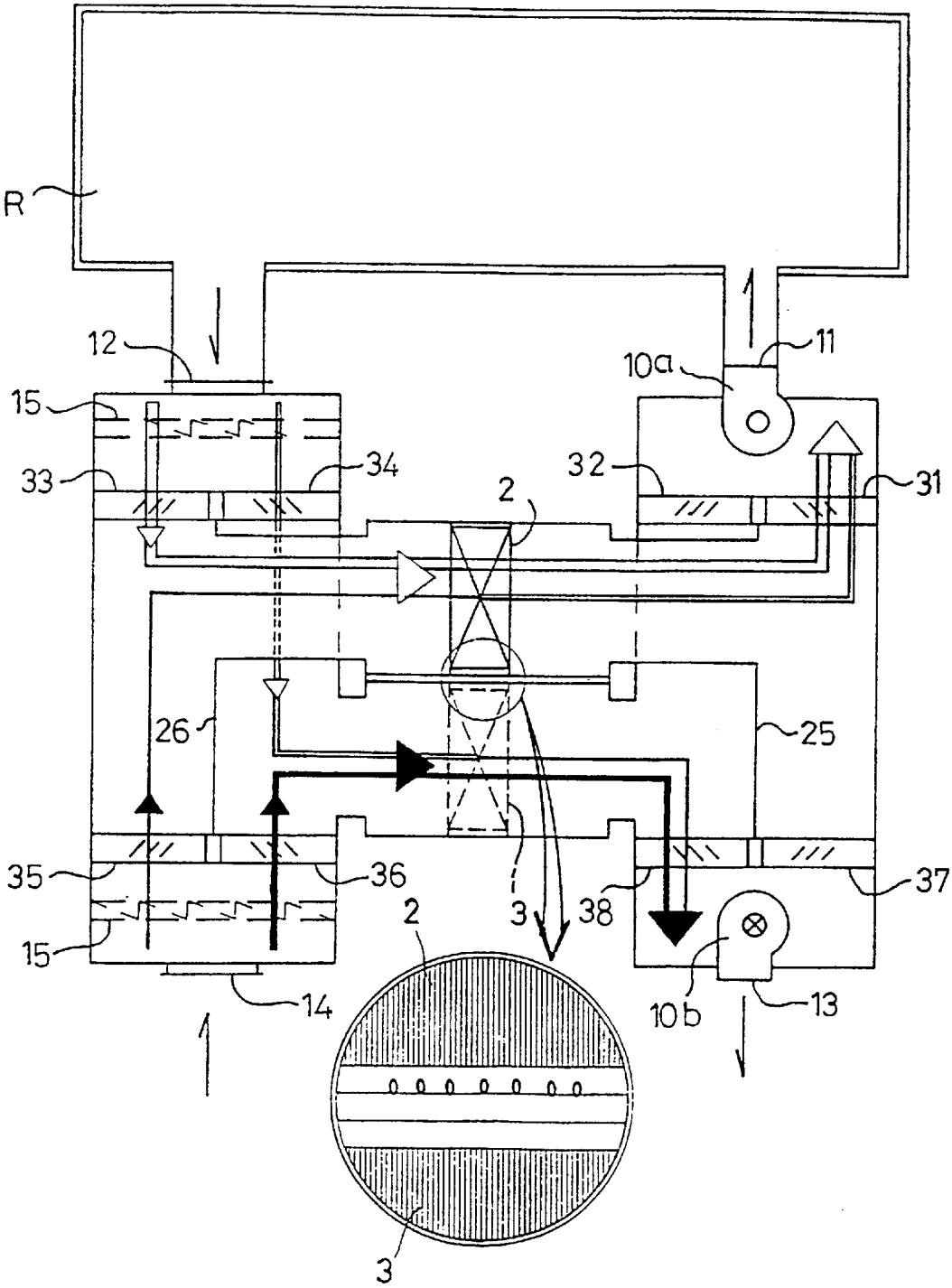
FIGS. 2 and 3 show diagrams for operating states at cooling mode and heating mode respectively and, FIGS. 4 and 5 show conceptional view of another embodiment according to the present invention as used as a thermo-hygrostat.

The operation at cooling mode for the above-mentioned arrangement according to the invention will be described with reference to FIG. 2. Here, the air flow route shown as dotted lines represents the air flow through the condenser 3 under the partition plate 21.

When the dampers 31 and 33, which are provided between the indoor air route and the evaporator 2, and the dampers 36 and 38, which are provided between the outdoor air route and the condenser 3, are opened, while the rest dampers 32,34,35 and 37 are closed, the warmed air in the room flows through the indoor air intake port 12 to the evaporator 2, where it is cooled, and then the cooled air enters the room through the indoor air discharge port 11. On the other hand, the external air which has been introduced through the external air intake port 14 absorbs heat while passing the condenser 3 and is exhausted to the outside through the outdoor discharge port 13, whereby the room cooling is accomplished.

In such a case of cooling mode, for example, when the opening for the opened dampers 31,33,36 and 38 is adjusted at around 70% and that for the previously closed dampers 32,34,35 and 36 is adjusted at 30%, then 70% of cold indoor air and 30% of warm outdoor air for ventilating will pass through the evaporator 2 to result in a fresh and cooled air mixture which is supplied to the room. At that time, the condensate water is produced in the evaporator 2 and then spreaded on the condenser 3, which improves the thermal efficiency of the condenser. In other words, the cooling action of the condenser is conducted combinedly through the air cooling and the water cooling. The lowered temperature of the mixed air consisting of 70% of warm external air and 30% of cold indoor air which flows through the condenser 3 contributes to the increase of the heat efficiency to remove heat from the condenser.

Figure 3:
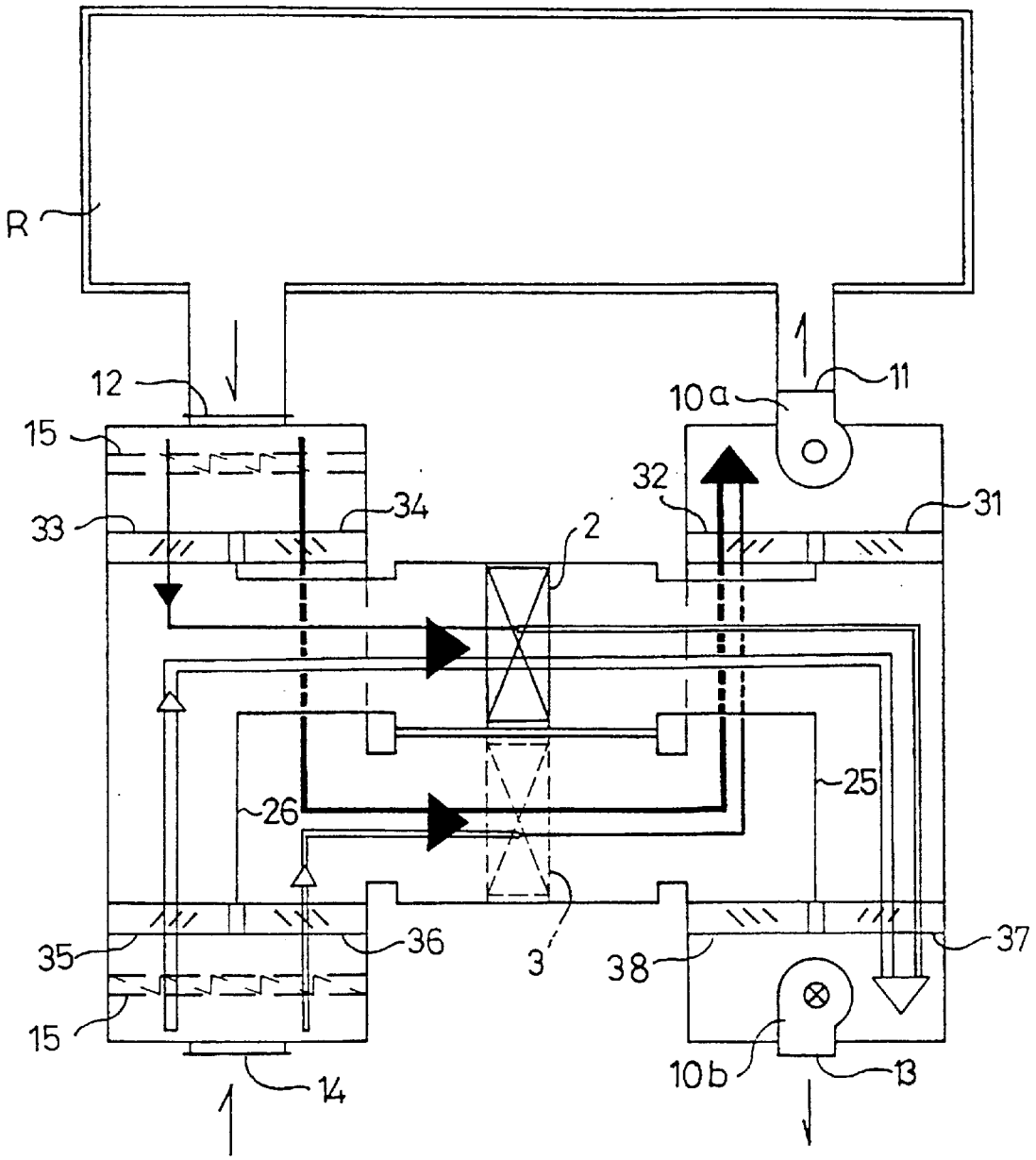

In case of heating mode as depicted in FIG. 3, in contrast to the foregoing, the dampers 32 and 34 located between the indoor air route and the condenser 3 and the dampers 35 and 37 located between the outdoor air route and the evaporator 2 are opened, while the rest dampers 31,33,36 and 38 are closed. Then the circulating indoor air is caused by the blower 10*a* to flow from the indoor air intake port 12 through the condenser 3 to be heated thereby before it returns to the room through the indoor air discharge port 11. On the other hand, the external air from the external air intake port 14 is sucked by the blower 10*b* to flow through the evaporator 2, where the air gives off heat, to be exhausted to the outdoor atmosphere through the external air discharge port 13, whereby the room heating cycle is completed.

In such a heating mode, if the dampers 32,34,35 and 37 are adjusted to be opened at around 70% instead of full opening and the group of dampers 31,33,36 and 38 are partly opened at around 30% instead of full closing, 70% of warm indoor air and 30% of cold outdoor air for ventilation would pass through the condenser 3 and be heated there, so that a fresher and warm air mixture can be supplied to the room. The warmer air mixture consisting of 70% of cold outdoor air and 30% of warm indoor air could be supplied to the evaporator 2 and therefore the capability or efficiency of removing heat from the evaporator would be improved mainly due to a larger temperature difference.

Figure 4:
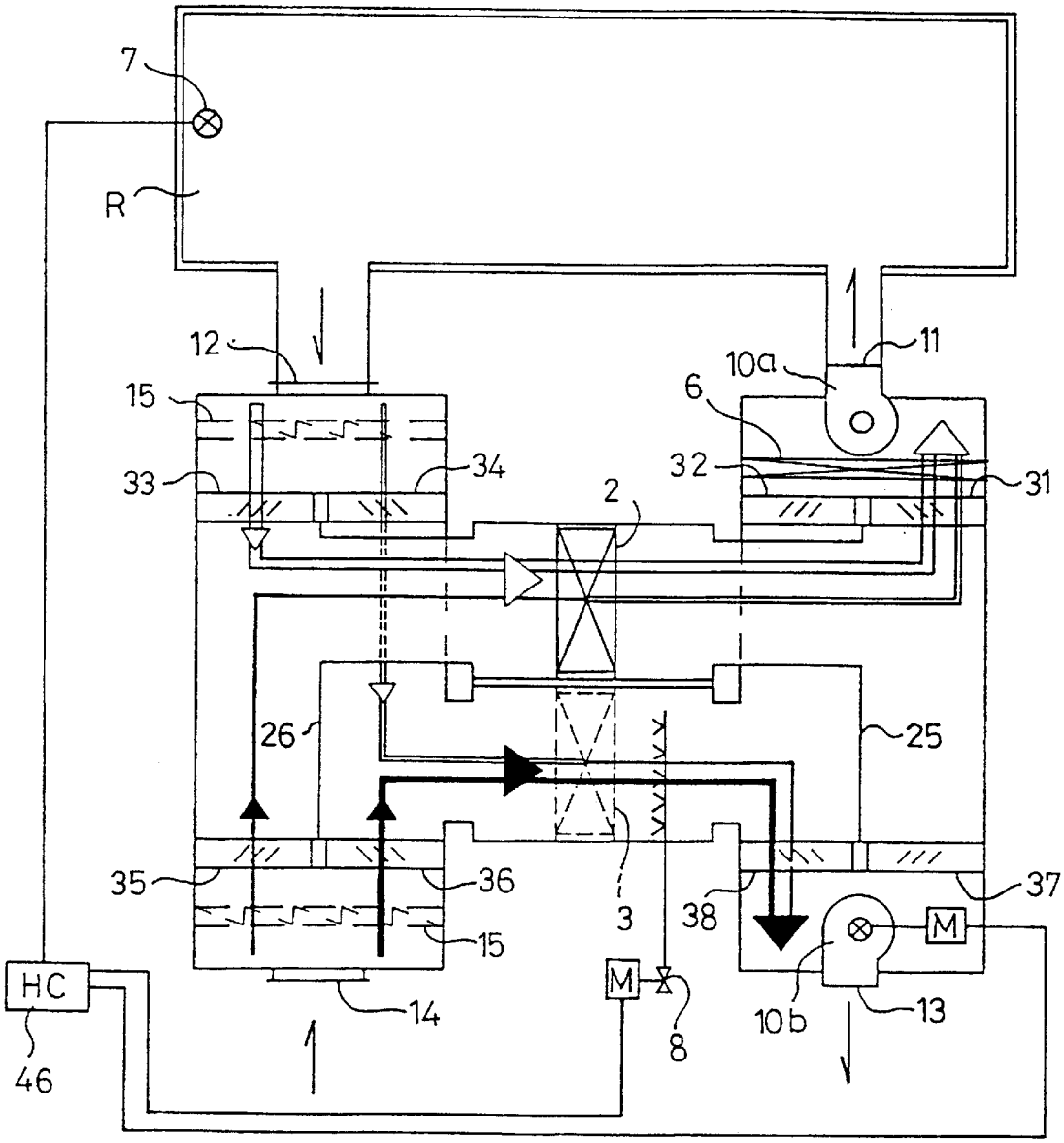
Figure 5:
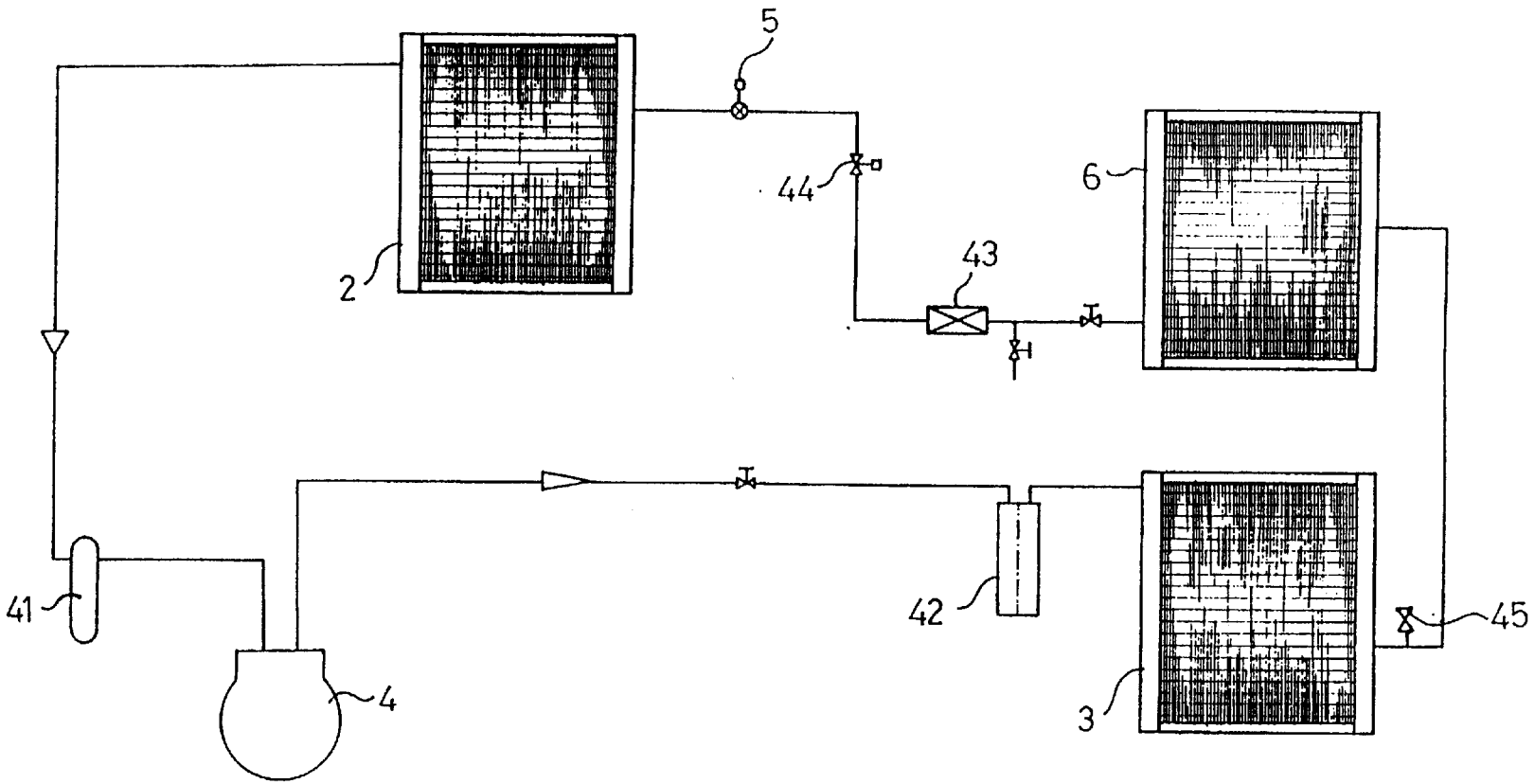

Now another embodiment of the present invention will be described with regard to FIGS. 4 and 5. As seen in the figures, the room R is provided with a humidity sensor 7 and there is additionally installed a reheater 6 between the indoor air discharge port 11 and the evaporator 2. Specifically, this reheater 6 is an auxiliary condenser, which is connected between the condenser 3 and the expansion valve 5, as depicted in FIG. 5. Further, a humidifier 8 is installed between the indoor air discharge port 11 and the condenser 3.

The numeral 41 denotes an accumulator, 42 denotes an oil separator, 43 denotes a filler dryer, 44 and 45 denote solenoid valves, for which further explanation is omitted because they are components usually employed in a refrigerant cycle.

The arrangement constructed as above is so operated in a cooling mode that the heat emission from the condenser 3 or the refrigerating fluid is regulated by controlling the air flow on the condenser blower 10*b* located at the outdoor discharge port 13 in response to the variation in the current relative humidity detected by the humidity sensor 7. Accordingly, the heat content included in the refrigerant fluid flowing through the reheater 6, which is connected subsequent to the condenser 3, is varied so as to appropriately adjust the temperature of the air flowing from the evaporator 2 toward the indoor air discharge port 11 by the emitted heat from the reheater 6 to resultantly adjust the relative humidity of the room. At that time, the refrigerating capacity would need to be increased with the increase of quantity of reheating, but the refrigerating capacity would increase because the refrigerant entering the expansion valve 5 will be cooled more corresponding to the increased reheat, whereby the drop in the refrigerating capacity due to the reheating is not resulted. If the relative humidity in the room is below the target value, it can be raised by lowering the temperature through normal cooling operation. And when the humidity sensor has detected that the indoor relative humidity is below the target value at a heating mode, a humidifier 8 is operated to increase the humidity of the air emerging from the condenser 3 to the indoor air discharge port 11. When the relative humidity in the room is above the target value, a normal heating operation will be needed to lower it.

The opening regulation for the dampers 31 through 38, the operation of the reheater 6 and the humidifier 8, the flow rate of the blower 10*a* or 10*b* or the like, as mentioned above, are naturally conducted by a controller (not shown) depending on the humidity sensor 7 for detecting the indoor humidity, a temperature sensor which was not shown, and preset values inputted optionally by the user. The numeral 46 denotes a humidity controller which may constitute a part of the controller or a separate unit.

As clear from the above, the air conditioner for combined cooling and heating according to the present invention, which device is a new construction based on an ordinary refrigerant cycle, can be operated either for cooling or for heating and with a high efficiency optionally by fully opening or closing, or regulating the opening for the flow of the entering or leaving air, or controlling the direction of the air flow. Furthermore, the reheater and the humidifier added on a conventional refrigeration cycle enable a precise regulation and maintenance of the indoor temperature and humidity without additional apparatus.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An air flow switching type air conditioner for both cooling and heating, comprising:

a compressor (4);

a condenser (3):

an evaporator (2);

a refrigerant pipe (9) connecting the compressor, the condenser, and the evaporator;

an air blower (10);

a case (1) comprising an indoor side discharge port (11) and an indoor side intake port (12), both the indoor ports (11, 12) being openable towards the inside of a room, and an outdoor side discharge port (13) and an outdoor side intake port (14), both outdoor ports openable to the outside of a room and separately partitioned by partition walls (25,26);

a heat exchange chamber (20) positioned between the indoor side discharge port and the indoor side intake port and between the outdoor side discharge port and the outdoor side intake port;

a first damper (31) provided between the evaporator and the indoor side discharge port;

a second damper (32) provided between the condenser and the indoor side discharge port;

a third damper (33) provided between the indoor side intake port and the evaporator;

a forth damper (34) provided between the indoor side intake port and the condenser;

a fifth damper (35) provided between the outdoor side discharge port and the evaporator;

a sixth damper (36) provided between the condenser and the outdoor side discharge port;

a seventh damper (37) provided between the outdoor side intake port and the evaporator;

an eighth damper (38) provided between the outdoor side intake port and the condenser;

said dampers moveable to control flow of air through said ports ; and a controller connected to and arranged to individually control the opening and closing of the dampers.

2. The air flow switching type air conditioner for both cooling and heating according to claim 1, wherein the heat exchange chamber is partitioned into upper and lower heat exchange chambers (22,23) by a horizontal partition plate (21) so that the evaporator is arranged in the upper heat exchange chamber (22) and the condenser is arranged in the lower heat exchange chamber (23), whereby condensing water produced in the evaporator flows down to the condenser.

3. The air flow switching type air conditioner for both cooling and heating according to claim 2, further comprising a humidity sensor (7) that is providable at a predetermined position in an interior of a room, and a reheater (6) is connected between the condenser and an expansion valve (5) or capillary tube, and wherein the reheater is positionable between the evaporator and the indoor air discharge port in order to heat air discharging into the inside of a room.

4. The air flow switching type air conditioner for both cooling and heating according to claim 1, further comprising a humidity sensor (7) that is providable at a predetermined position in an interior of a room, and a reheater (6) is connected between the condenser and an expansion valve (5) or capillary tube, and wherein the reheater is positionable between the evaporator and the indoor air discharge port in order to heat air discharging into the inside of a room.

* * * * *